US005288583A

United States Patent [19]

Osumi et al.

[11] Patent Number: 5,288,583

[45] Date of Patent: Feb. 22, 1994

[54] DEVELOPING METHOD USING SINGLE-COMPONENT NONMAGNETIC TONERS

[75] Inventors: Kunihisa Osumi; Toshiuyuki Shirai; Shunji Konda, all of Shizuoka, Japan

[73] Assignee: Tomoegawa Paper Co., Ltd., Tokyo, Japan

[21] Appl. No.: 825,573

[22] Filed: Jan. 24, 1992

[30] Foreign Application Priority Data

Jan. 31, 1991 [JP] Japan ..... 3-029126

[51] Int. Cl.[5] ..... G03G 13/08; G03G 13/16

[52] U.S. Cl. ..... 430/126; 430/101; 430/110; 430/111; 430/903

[58] Field of Search ..... 430/101, 111, 903, 126

[56] References Cited

U.S. PATENT DOCUMENTS 3,731,146 5/1973 Bettiga et al. ..... 430/101 X 4,849,316 7/1989 Kawaski et al. ..... 430/903 X

FOREIGN PATENT DOCUMENTS 100452 6/1984 Japan ..... 430/111

*Primary Examiner*—Roland Martin

*Attorney, Agent, or Firm*—Finnegan, Henderson, Farabow, Garrett & Dunner

[57] ABSTRACT

The present invention provides a contact-type developing method for developing a static latent image using a single-component non-magnetic toner wherein a non-magnetic toner fusion is hardly occurred. In the contact-type developing method for developing a static latent image using a single-component non-magnetic toner, a single-component non-magnetic toner essentially consisting of a coloring agent and a binder resin of a styrene copolymer having a number average molecular weight of 8,000 to 30,000 and a weight average molecular weight of 100,000 to 300,000, and having a single peak molecular-weight distribution in a gel partition chromatograph is employed.

5 Claims, 1 Drawing Sheet

DEVELOPING METHOD USING SINGLE-COMPONENT NONMAGNETIC TONERS

BACKGROUND OF THE INVENTION

1. Field of the invention

The present invention relates to a contact-type developing method for developing a static latent image using a single-component non-magnetic toner.

2. Prior art

Conventional developing methods for developing static latent images using toners are divided roughly into two main classes. One is a two-component type developing method using a two-component developer essentially consisting of a non-magnetic toner and a carrier. The other is a single-component type developing method using a single component developer essentially consisting of a magnetic toner. Various improvements in connection with the two-component type and single-component type developing methods have been proposed.

However, the developing method using the two-component developer has the following drawbacks as compared with the developing method using the single-component developer:

(1) there is a need for a toner density sensor to control the ratio of the toner and the carrier;

(2) the life of the developer is short; and (3) a mixer for mixing the developer must be handled with care and a large developing machine must be utilized.

The single-component type developing method using a magnetic toner has the following disadvantages:

(1) an electrostatic charge element must be formed as a sleeve or a blade and has less electrostatic charge stability and capacity as compared with a carrier;

(2) there is a need for a precision developing machine to produce a uniform magnetic brush; and (3) the magnetic toner has fewer transferring, fixing, and environmental properties, and produces more damage to the photo-conductor than a non-magnetic toner.

In order to overcome the disadvantages described above and provide a small developing machine, the developing methods using single-component non-magnetic developers (toners) have been considered extremely efficient and attractive, and some of these have been practical.

The developing methods using single-component non-magnetic developers are roughly divided into two types: one is a contact-type developing method using single-component non-magnetic developers for developing a static latent image on a photo-conductor by contacting a developing roll which carries a toner with the photo-conductor. The other is a non-contact type developing method using single-component non-magnetic developers for developing a static latent image on a photo-conductor by virtue of flying a toner provided on a developing roll onto the photo-conductor which is adjacent to the developing roll with a gap.

The non-contact type developing method using single-component non-magnetic developers has an advantage in that the mechanical load exerted on the toners is smaller than in the contact-type developing method, since the toners are triboelectrically charged by only charging member. However, in the non-contact type developing method, the toner-flying properties tend disadvantageously to depend on the environmental conditions.

On the other hand, the contact-type developing method using single-component non-magnetic developers has an advantage in that good developing properties are exhibited. In the contact-type developing method, the mechanical load exerted on the toners is considerably greater than in the non-contact type developing method since not only a frictional force generated by the difference between the peripheral speeds of the photo-conductor and the developing roll, but also a triboelectric charging force caused by the charging member during the formation of a thin layer of toner on the developing roll is exerted. Therefore, one of the most important points associated with the contact-type developing method using single-component non-magnetic developers is that the toners not be fused to the triboelectric-charging member and the photo-conductor. In addition, another important point is that the photo-conductors and the developing roll not be cracked. In order to obtain a toner which will undergo reduced binding to the developing roll or the photo-conductor, one method which is effective is the use of a material having a high transition temperature as the binder resin used in the toner. However, this alone is not satisfactory.

SUMMARY OF THE INVENTION

In view of the above mentioned problems associated in the conventional contact-type developing method, it is an object of the present invention to provide a contact-type developing method for developing a static latent image using a single-component non-magnetic toner wherein the non-magnetic toner undergoes negligible fusion to the developing roll and the photo-conductor produced in a developing device.

One aspect of the present invention is directed toward the provision of a contact-type developing method for developing a static latent image using a single-component non-magnetic toner, comprising the successive steps of:

a) preparing (1) a developing device including at least a developing roll for carrying a toner and a control member for controlling the thickness of a toner layer provided near the developing roll and, (2) a single-component non-magnetic toner consisting essentially of a coloring agent and a binder resin of a styrene copolymer where the number average molecular weight is from 8,000 to 30,000, and where the weight average molecular weight is from 100,000 to 300,000, and which has a single peak molecular-weight distribution in gel permeation chromatograph;

b) feeding the single-component non-magnetic toner onto the developing roll;

c) forming a thin layer of toner by virtue of the control member for controlling the thickness of the toner layer to charge the toner;

d) causing the charged toner to contact with a carrier for holding a static latent image to develop the static latent image; and e) transferring the static latent image to a paper.

The above objects, effects, features, and advantages of the present invention will become more apparent from the following description of preferred embodiments thereof.

DETAILED DESCRIPTION OF THE INVENTION

Figure 1:
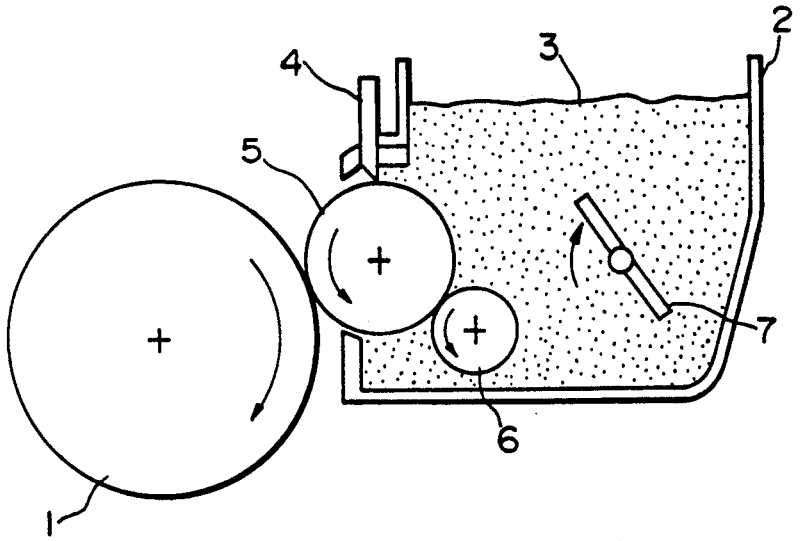
FIG. 1 is a cross-sectional view of a developing device using a single-component toner in order to carry out a developing method according to the present invention.

The present inventors have carried out extensive research in order to solve the above-described problems associated with the conventional contact-type developing method using single-component non-magnetic toner. As a result, it has been found that using a single-component non-magnetic toner which consists essentially of a coloring agent and a binder resin of styrene copolymer having a number average molecular weight (hereafter, referred to as "Mn") of 8,000 to 30,000 and a weight average molecular weight (hereafter, referred to as "Mw") of 100,000 to 300,000, and having a single peak molecular-weight distribution in a gel permeation chromatograph, is efficient for obtaining a toner with good fixing properties and for producing negligible toner fusion to the developing roll and the photo-conductor equipped in a developing device.

In addition, in order to have sufficient off-set properties and to cause negligible the toner fusion to the developing roll, the photo-conductor, and the control member (blade) for controlling the thickness of the toner layer in the developing device, it is extremely effective to disperse a polyolefin wax having a particle size set in the range of 0.5 μm or less into the toner.

Hereinafter, the present invention will be explained in detail.

FIG. 1 is a cross-sectional view of a developing device using a single-component toner for carrying out a contact-type developing method using a single-component non-magnetic toner according to the present invention. In FIG. 1, symbols "1", "2", "3", "4", "5", "6", and "7", respectively, designate a cylindrical photo-conductor drum which is a carrier holding a static latent image, a hopper, a toner, a control member for controlling the thickness of a toner layer, a developing roll, a toner-feeding roll, and a stirrer. In this developing device, the static latent image is formed on the photo-conductor drum 1 using the conventional electrophotography method. Toner 3 stored in hopper 2 is carried on developer roll 5 by virtue of control member 4 so that the uniform thickness of the toner layer is formed on the developer roll 5. During formation of the toner layer, toner 3 is triboelectrically charged. Control member 4 may be connected to a direct or alternating current power source, so that an electric field between the developing roll and the control member is generated. The toner carried on developing toner 5 is caused to contact with photo-conductor drum 1 having the static latent image by virtue of rotation of the developing roll 5 to develop the latent image.

In the developing device employed in the present invention, developing roll 5 is made of an elastic material, for example, various rubbers such as silicon rubber, sponge rubber, urethane foam, or the like. The material of developing roll 5 preferably includes conductive powders so as to impress a bias voltage, or the developing roll 5 is preferably coated by a conductive coating material. In addition, a laminate resin layer may be provided on the surface of the developing roll. The laminate thin layer is made of a material having film forming properties and an adequate elasticity as a toner carrier layer, for example, a fluorine contained resin, a silicon resin, a polyester resin, a polycarbonate resin, or the like. The toner carrier layer is formed in a range of 10 μm to 200 μm thickness. As control member 4, for example, a synthetic rubber such as silicon rubber or metallic plate such as brass may be employed.

The toner employed in the developing method using single-component non-magnetic developer according to the present invention consists essentially of a binder resin and a coloring agent.

In order to reduce toner fusion to the developing roll or the photo-conductor, it is effective that the resin included in the toner be hard. However, the toner having a hard resin is not practical because the fixing properties of the toner are inhibited.

After the present inventors had carried out extensive research in connection with the relation between toner fusion and the properties of the resin employed in the toner, it was found that the average molecular weight and the molecular weight distribution of the resin are advantageously affected by the improvement of toner fusion.

Toner fusion to the developing roll and the control blade for controlling the toner thickness depends on the molecular weight of the low molecular weight component of the resin and the molecular weight distribution of the resin. In other words, toner fusion largely depends on the proportion of those resin components which are liable to fuse to the developing roll and the control blade, and on the entanglement between the molecules of the resin.

If the resin has a large proportion of low molecular weight components, toner fusion is caused from the low molecular weight parts. In this case, it is possible to prevent the toner from fusing by virtue of the high molecular weight components being present together with the low molecular weight components. However, the high molecular weight components are not essentially compatible with the low molecular weight components.

Therefore, in order to exhibit anti toner-fusion properties, and to make the low molecular weight components compatible with the high molecular weight components, the high molecular weight components having the same peak in a molecular weight distribution as the low molecular weight components are effectively associated with the low molecular weight components. The resin having only one peak in the molecular weight distribution has a good entanglement between the molecules of the resin. For this reason, the high molecular weight components can control the toner fusion caused by the low molecular weight components.

In the present invention, the molecular weight at the peak in the molecular weight distribution of the polymer is measured by conventional methods, for example, gel permeation chromatography, under suitable conditions. The suitable conditions are, for example, as follows:

(1) Measurement condition

Temperature: 25° C.

Solvent: tetrahydrofuran

Flow velocity: 1 ml / min (2) Column

A combination of several silica-gel columns which are commercially available is employed. For example, a pair of "Shodex A-80M", produced by Showa Denko Co., Ltd., is acceptable.

(3) Analytical curve polystyrene can be employed. The standard polystyrenes are commercially available from, for example, Pressure Chemical Co., or Toyo Soda Industries Co., Ltd. wherein the molecular weight is $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, or $4.48\times10^3$. It is preferable to employ at least 10 standard polystyrenes.

(4) Detector

A refractive index detector (RI detector), for example, "SE-31" produced by Showa Denko Co., Ltd., is employed.

The styrene monomer which is acceptable in the styrene copolymer employed in the present invention includes styrenes such as styrene, α-mehtylstyrene, p-chlorostyrene, or the like, and their derivatives. As the copolymer component, acrylic alkyl ester wherein the alkyl group has 1 to 15 carbon atoms, or methacrylic alkyl ester wherein the alkyl group has 2 to 15 carbon atoms is preferably employed. The other copolymer component includes a vinyl monomer such as acrylonitrile, maleic acid, maleic ester, methyl methacrylate, methyl acrylate, vinyl chloride, vinyl acetate, vinyl benzoate, vinyl methyl ketone, vinyl hexyl ketone, vinyl methyl ether, vinyl ethyl ether, vinyl isobutyl ether, or the like. The vinyl monomer may be present in the amount of 30% by weight or less based on the total weight of the polymer, preferably in the amount of 20% by weight or less based on the total weight of the polymer.

The copolymerization ratio of the styrene monomer is preferably in the range of 50% by weight to 90% by weight. If the copolymerization ratio of the styrene monomer is less than 50% by weight, the developing properties of the toner particles, anti-blocking properties, anti-offset properties, and the like are reduced On the other hand, if the copolymerization ratio of the styrene monomer in the styrene copolymer is greater than 90% by weight, the fixing temperature is raised.

The styrene copolymer employed in the present invention can be synthesized according to conventional methods such as a suspension polymerization method, an emulsion polymerization method, a solution polymerization method, a block polymerization method, or the like. In order to adjust the molecular weight, the conventional molecular weight conditioner, for example a mercaptan such as lauryl mercaptan, phenyl mercaptan, butyl mercaptan, dodecyl mercaptan, or the like, or a halogenated carbon such as carbon tetrachloride, carbon tetrabromide, or the like, can be employed.

Furthermore, to the binder resin in the toner employed in the present invention, other known resins excluding the resins described above can be added. For example, a polyester resin, an epoxy resin, a silicon resin, a polystyrene, a polyamide resin, a polyurethane resin, an acryl resin, or the like may be included in the binder resin. These known resins are preferably in the amount of 30% by weight or less based on the total weight of the binder resin.

The coloring agent of the toner employed in the present invention includes all or any conventional coloring agents. For example, carbon black, iron black, nigrosine, benzidine yellow, quinacridone, rhodamine B, copper phthalocyanine blue, or the like can be employed.

Various additives can be added to the toner employed in the present invention as necessary. For example, a charge control agent such as a nigrosine compound or a metal complex, a lubricity compound such as polytetrafluoroethylene, a fatty acid or the metal salt thereof, or bisamide, a plasticizer such as dicyclohexyl phthalate can be added to the toner.

A toner of the type employed in the present invention which has a binder resin of styrene copolymer is utilized in a printer such uses a contact type of single-component non-magnetic developer, this printer having a print speed of about 15 sheets per minute. For this reason, the temperature variation of the fixing roll is not greater than that of a copy machine. Therefore, the off-set of the toner on the fixing thermal roll rarely occurs. If it is necessary to further improve the off-set properties, the size of polyolefin wax dispersed in the toner is made 0.5 μm or less of the particle size while the amount included in the toner is made 3% and more. In order to disperse the polyolefin wax so as to have 0.5 μm or less of the particle size in the toner, it is effective to heat-melt and knead the raw materials of the toner in an adequate condition.

As the polyolefin wax, polyethylene, polypropylene, ethylene-propylene copolymer, ethylene-vinyl acetate copolymer, ethylene-ethylene acrylate copolymer, an ionomer having a polyethylene skeleton, or the like is acceptable. The copolymer preferably includes the olefin monomer in the amount of 50% by mole or more, more preferably in the amount of 60% by mole or more.

EXAMPLES

The present invention will be explained in detail below with reference to the examples. The present invention is not restricted to the examples. In the examples, all "parts" designate "parts by weight".

EXAMPLE 1

| Components: | |
|---|---|
| Styrene/acrylic acid ester copolymer resin (having one peak in a molecular weight distribution, Mn: 15,000, Mw: 210,000, Mw/Mn: 14) | 90 parts |
| Polypropylene wax ("VISKOL 550P", produced by Sanyo Chemical Industries Co., Ltd.) | 3 parts |
| Charge control agent (metal-included dye, "BONTRON S-34", produced by Orient Chemical Industries, Ltd.) | 1 part |
| Carbon black ("MA-100", produced by Mitsubishi Chemical Industries Co., Ltd.) | 6 parts |

A mixture of the above-described components has heat-melted and kneaded by means of a biaxial kneading machine. The kneaded mixture was cooled and pulverized by a jet mill. The pulverized mixture was classified by an air classifier to obtain a single-component non-magnetic toner according to the present invention having an average particle size of 12 μm.

EXAMPLE 2

| Components: | |
|---|---|
| Styrene/acrylic acid ester copolymer resin (having one peak in a molecular weight distribution, Mn: 20,000, Mw: 300,000, Mw/Mn: 15) | 90 parts |
| Polypropylene wax ("VISKOL 550P", produced by Sanyo Chemical Industries Co., Ltd.) | 3 parts |
| Charge control agent (metal-included dye, "BONTRON S-34", produced by Orient Chemical Industries, Ltd.) | 1 part |
| Carbon black | 6 parts |

-continued

| Components: | |
|---|---|
| ("MA-100", produced by Mitsubishi Chemical Industries Co., Ltd.) | |

A mixture of the above-described components was heat-melted and kneaded by means of a biaxial kneading machine. The kneaded mixture was cooled and pulverized by a jet mill. The pulverized mixture was classified by an air classifier to obtain a single-component non-magnetic toner according to the present invention having an average particle size of 12 μm.

EXAMPLE 3

| Components: | |
|---|---|
| Styrene/acrylic acid ester copolymer resin (having one peak in a molecular weight distribution, Mn: 25,000, Mw: 180,000, Mw/Mn: 7.2) | 90 parts |
| Polypropylene wax ("VISKOL 550P", produced by Sanyo Chemical Industries Co., Ltd.) | 3 parts |
| Charge control agent (metal-included dye, "BONTRON S-34", produced by Orient Chemical Industries, Ltd.) | 1 part |
| Carbon black ("MA-100", produced by Mitsubishi Chemical Industries Co., Ltd.) | 6 parts |

A mixture of the above-described components was heat-melted and kneaded by means of a biaxial kneading machine. The kneaded mixture was cooled and pulverized by a jet mill. The pulverized mixture was classified by an air classifier to obtain a single-component non-magnetic toner according to the present invention having an average particle size of 12 μm.

COMPARATIVE EXAMPLE 1

| Components: | |
|---|---|
| Styrene/acrylic acid ester copolymer resin (having two peaks in a molecular weight distribution, Mn: 9,000, Mw: 350,000, Mw/Mn: 38.9) | 90 parts |
| Polypropylene wax ("VISKOL 550P", produced by Sanyo Chemical Industries Co., Ltd.) | 3 parts |
| Charge control agent (metal-included dye, "BONTRON S-34", produced by Orient Chemical Industries, Ltd.) | 1 part |
| Carbon black ("MA-100", produced by Mitsubishi Chemical Industries Co., Ltd.) | 6 parts |

A mixture of the above-described components was heat-melted and kneaded by means of a biaxial kneading machine. The kneaded mixture was cooled and pulverized by a jet mill. The pulverized mixture was classified by an air classifier to obtain a single-component non-magnetic toner according to the present invention having an average particle size of 12 μm.

COMPARATIVE EXAMPLE 2

| Components: | |
|---|---|
| Styrene/acrylic acid ester copolymer resin (having three peaks in a molecular weight distribution, Mn: 5,000, Mw: 294,000, Mw/Mn: 58.8) | 90 parts |
| Polypropylene wax ("VISKOL 550P", produced by Sanyo Chemical Industries Co., Ltd.) | 3 parts |

-continued

| Components: | |
|---|---|
| Charge control agent (metal-included dye, "BONTRON S-34", produced by Orient Chemical Industries, Ltd.) | 1 part |
| Carbon black ("MA-100", produced by Mitsubishi Chemical Industries Co., Ltd.) | 6 parts |

A mixture of the above-described components was heat-melted and kneaded by means of a biaxial kneading machine. The kneaded mixture was cooled and pulverized by a jet mill. The pulverized mixture was classified by an air classifier to obtain a single-component non-magnetic toner according to the present invention having an average particle size of 12 μm.

COMPARATIVE EXAMPLE 3

| Components: | |
|---|---|
| Styrene/acrylic acid ester copolymer resin (having two peaks in a molecular weight distribution, Mn: 4,000, Mw: 198,000, Mw/Mn: 49.5) | 90 parts |
| Polypropylene wax ("VISKOL 550P", produced by Sanyo Chemical Industries Co., Ltd.) | 3 parts |
| Charge control agent (metal-included dye, "BONTRON S-34", produced by Orient Chemical Industries, Ltd.) | 1 part |
| Carbon black ("MA-100", produced by Mitsubishi Chemical Industries Co., Ltd.) | 6 parts |

A mixture of the above-described components was heat-melted and kneaded by means of a biaxial kneading machine. The kneaded mixture was cooled and pulverized by a jet mill. The pulverized mixture was classified by an air classifier to obtain a single-component non-magnetic toner according to the present invention having an average particle size of 12 μm.

0.4 parts of hydrophoic silica ("H 2000", produced by Hexist Co , Ltd.) was added to 100 parts of each of the single-component non-magnetic toners of the present invention according to Examples 1 to 3 and the comparative single-component non-magnetic toners according to Comparative Examples 1 to 3. In order to cause the hydrophobic silica to adhere to the surfaces of the toner particles of each of single-component non-magnetic toners described above, the mixture was mixed for approximately 2 minutes by means of a high-speed mixing machine.

The single-component non-magnetic toners obtained above were set in an inversion-developing type printer ("LP 1060-SP 3", produced by Richo Co., Ltd.) having an organic photo-conductor drum and a control member for controlling the thickness of the toner layer which is made of silicon rubber. 10,000 sheets were printed using the printer. The image density of both the initial stage and the 10,000th printed sheet, and toner fusion to the developing roll were evaluated.

The results described above are shown in Table 1. The image density in Table 1 was measured by process measurements Macbeth RD-914. The evaluation (◎, ○, Δ, ×) in connection with the toner fusion to the developing roll indicated in Table 1 was carried out by visual observation.

Evaluation:

◎: No toner fusion was observed.

○: Slight toner fusion was observed, however it presented no problems for practical use.

Δ: Slight toner fusion was observed, presenting problems for practical use.

×: Extreme toner fusion was observed.

TABLE 1

| Sample | Resin Mn | Resin Mw | Resin Mw/Mn | Peak in gel partition chromatograph | Image density Initial sheet | Image density 10,000th sheet | Toner fusion to the developing roll |
|---|---|---|---|---|---|---|---|
| Example 1 | 15,000 | 210,000 | 14 | 1 | 1.46 | 1.44 | ◎ |
| Example 2 | 20,000 | 300,000 | 15 | 1 | 1.45 | 1.45 | ○ |
| Example 3 | 25,000 | 180,000 | 7.2 | 1 | 1.42 | 1.40 | ◎ |
| Comparative Example 1 | 9,000 | 350,000 | 38.9 | 2 | 1.46 | 1.33 | Δ |
| Comparative Example 2 | 5,000 | 294,000 | 58.8 | 3 | 1.41 | 1.20 | X |
| Comparative Example 3 | 4,000 | 198,000 | 49.5 | 2 | 1.42 | 1.15 | X |

According to the present invention, the single-component non-magnetic toner which includes the binder resin having the fixed amounts of Mn and Mw and a single peak molecular weight distribution measured by gel partition chromatograph exhibits a superior image density on the initial sheet and the final sheet after a continuous copying test is carried out, and shows no toner fusion to the developing roll.

The present invention has been described in detail with respect to embodiments and, from the foregoing, it will now be apparent to those skilled in the art that changes and modifications may be made without departing from the invention in its broader aspects. It is the intention, therefore, in the appended claims to cover all such changes and modifications as fall within the true spirit of the invention

What is claimed is:

1. A contact-type developing method for developing a static latent image using a single-component non-magnetic toner, comprising the steps of:

a) preparing (1) a developing device having at least a developing roll for carrying a toner and a control member for controlling the thickness of a toner layer provided near the developing roll and, (2) a single-component non-magnetic toner consisting essentially of a coloring agent and a binder resin of a styrene copolymer having a number average molecular weight of 8,000 to 30,000 and a weight average molecular weight of 100,000 to 300,000, and having a single peak molecular-weight distribution in a gel partition chromatograph, wherein the styrene copolymer is obtained by a polymerization reaction between (i) a styrene monomer selected from the group consisting of styrene, α-methyl-styrene, p-chlorostyrene, and their derivatives and (ii) a compounds selected from the group consisting of an acrylic alkyl ester wherein the alkyl group has 1 to 15 carbon atoms, a methacrylic alkyl ester wherein the alkyl group has 2 to 15 carbon atoms, and a vinyl monomer;

b) feeding the single-component non-magnetic toner into the developing roll;

c) forming a thin layer of toner by virtue of the control member for controlling the thickness of the toner layer to charge the toner;

d) causing the charged toner to contact with a carrier for holding a static latent image to develop the static latent image; and e) transferring the latent image to paper.

2. A contact-type developing method for developing a static latent image using a non-magnetic single-component toner as recited in claim 1, wherein the single-component non-magnetic toner further comprises a polyolefin wax having a particle size 0.5 μm or smaller in the amount of 3.0% by weight or more based on the total weight of the toner.

3. A contact-type developing method for developing a static latent image using a non-magnetic single-component toner as recited in claim 1, wherein the styrene monomer has a copolymerization ratio in the range of 50% by weight to 90% by weight.

4.. A contact-type developing method for developing a static latent image using a non-magnetic single-component toner as recited in claim 1, wherein the coloring agent is selected from the group consisting of carbon black, iron black, nigrosine, benzidine yellow, quinacridone, rhodamine B, and copper phthalocyanine blue.

5. A contact-type developing method for developing a static latent image using a non-magnetic single-component toner as recited in claim 1, wherein the non-magnetic single-component toner further comprises at least one of a charge control agent, a lubricity compound, and a plasticizer.

* * * * *

UNITED STATES PATENT AND TRADEMARK OFFICE

CERTIFICATE OF CORRECTION

PATENT NO. : 5,288,583

DATED : February 22, 1994

INVENTOR(S) : Kunihisa Osumi et al.

It is certified that error appears in the above-indentified patent and that said Letters Patent is hereby corrected as shown below:

Claim 1, Column 10, Line 1, change "compounds" to --compound--.

Claim 4, Column 10, Line 41, change "4.." to --4.--.

Signed and Sealed this

Thirteenth Day of December, 1994

Bruce Lehman

*Attest:*

BRUCE LEHMAN

*Attesting Officer*

*Commissioner of Patents and Trademarks*